United States Patent [19]

Moore et al.

[11] 3,987,968

[45] Oct. 26, 1976

[54] FLOW-THROUGH MOIST PULP FIBERIZING DEVICE

[75] Inventors: Danny Raymond Moore, Perry, Fla.; Orin Alvin Shields, Memphis, Tenn.

[73] Assignee: The Buckeye Cellulose Corporation, Cincinnati, Ohio

[22] Filed: Dec. 22, 1975

[21] Appl. No.: 643,136

[52] U.S. Cl. ..... 241/28; 241/29; 241/58; 241/154; 241/188 R

[51] Int. Cl.[2] ..... B27L 11/08

[58] Field of Search ..... 241/18, 27, 28, 29, 241/45, 57, 58, 154, 185 R, 186 R, 186.2, 188 R

[56] References Cited

UNITED STATES PATENTS

| | | | |
|---|---|---|---|
| 744,381 | 11/1903 | Moor | 241/188 R |
| 749,574 | 1/1904 | McAuley | 241/45 |
| 3,508,713 | 4/1970 | Huppke | 241/188 R |

*Primary Examiner*—Granville Y. Custer, Jr.
*Attorney, Agent, or Firm*—Melville, Strasser, Foster & Hoffman

[57] ABSTRACT

A moist pulp fiberization device wherein picked moist pulp enters a tubular chamber behind a fiberizing blade mounted coaxially within the chamber, the fiberizing blade being configured to produce a turbulent vortex with little, if any, pressure differential within the chamber, the flow of pulp through the chamber being induced and controlled by drawing a vacuum on the trailing end of the chamber and providing an adjustable orifice plate intermediate the fiberizing blade and the trailing end of the chamber; if required, the fibers withdrawn from the chamber may be successively introduced into one or more additional chambers of like configuration to effect substantially complete fiber separation, whereupon the separated fibers are discharged for subsequent processing and use.

20 Claims, 5 Drawing Figures

FLOW-THROUGH MOIST PULP FIBERIZING DEVICE

BACKGROUND OF THE INVENTION

This invention relates to apparatus for fiberizing a moist sheet of pulp fibers into individual fibers, and while its utility is not so limited, the invention is particularly suited for the fiberization of cellulosic fibers which have been coated and/or internally impregnated with wet strength resins.

While numerous expedients have hitherto been proposed for fiberizing sheets of moist fibers into individual fibers, the effectiveness of such devices varies widely as does the quality of the fibers which are obtained. In particular, conventional mechanical fiberizing techniques tend to produce fiber damage - both length reduction and fibrillation - as well as knotting of the fibers.

The majority of the devices currently in use for fiberizing either wet or dry cellulose fibers are primarily dependent upon mechanical impact for fiber separation, which results in excessive fiber damage as well as knot formation. This is particularly true for wet cellulose fibers because of the tendency of the wet fibers to reform into knots. Efforts to reduce the knot content by reducing clearances or increasing retention times result in increased fiber damage.

It has also been proposed to fiberize cellulose pieces by feeding them through a tunnel containing one or more sets of fan blades and recirculating the fibers for as many passes as are required to effect the desired fiberization. Such arrangement has a cyclone-like effect and is inherently knot producing; and at the velocities involved, considerable fiber damage also can occur.

In contrast to the foregoing, the present invention provides a fiberization device uniquely capable of achieving in excess of 99% complete fiber separation without excessive damage to the fibers.

SUMMARY OF THE INVENTION

The present invention relates to a fiberization device which utilizes a combination of mechanical impact, mechanical agitation, air agitation, and air drying to effect substantially complete fiber separation while minimizing the knot content and fiber damage.

In accordance with the invention, the device comprises a tubular housing or chamber having a fiberizing blade mounted coaxially therein adjacent its leading end, small pieces of wet pulp being fed into the chamber, either radially or coaxially, behind the fiberizing blade. The small pieces of pulp are formed in a picker, which forms no part of the present invention, the sole purpose of the picker being to break-up the pulp mat into pieces which are sufficiently small to be fed into the fiberizing device. The pieces of pulp are drawn into the chamber through an inlet conduit leading from the discharge side of the picker to the leading end of the chamber.

Upon entering the chamber, the pieces of pulp contact the rapidly revolving fiberizing blade, which preferably comprises four blade arms arranged in opposing pairs. The fiberizing blade produces a turbulent vortex but very little, if any, pressure differential throughout the fiberization chamber. This lack of fiberizing blade pressure differential is believed essential to the thorough fiberization of the pulp and leaves fiber passage through the chamber to be engendered and controlled by an externally applied pressure differential, preferably by means of a centrifugal fan operated as a vacuum exhaust connected to the trailing or discharge end of the chamber.

In accordance with the invention, the chamber is provided with an axially adjustable orifice plate having a restricted opening therein, the orifice plate being spaced from the fiberizing blade to form a fiberizing zone therebetween. The orifice plate controls the retention time of the fibers in the fiberizing zone so that adequate time is allowed for fiber separation. The fibers flow out of the fiberizing zone through the orifice plate, being conveyed by the vacuum induced air stream, the air stream so formed acting to transport the fibers in a manner which will promote drying and prevent knot formation.

In accordance with the invention, the device may comprise one, two or more stages, depending upon the nature and character of the fibers being separated. For example, where the fibers are impregnated with wet strength resins, it is preferred to provide a series of three chambers of like construction, with the fibers drawn from the first chamber being transported by the air stream into the leading end of a second chamber and thereafter into a third chamber. Upon discharge from the device, irrespective of the number of chambers, the fibers may be conveyed through suitable conduit means for subsequent processing, such as introduction into a drier to complete the drying of the fibers.

The invention also contemplates the provision of adjustable baffle means in conjunction with the chambers to further control the differential air flow to obtain optimum operating conditions; and also the introduction of heated air into the chambers to assist in drying the fibers and curing the resin, if they are resin saturated.

DESCRIPTION OF THE PREFERRED EMBODIMENT

Figure 1:
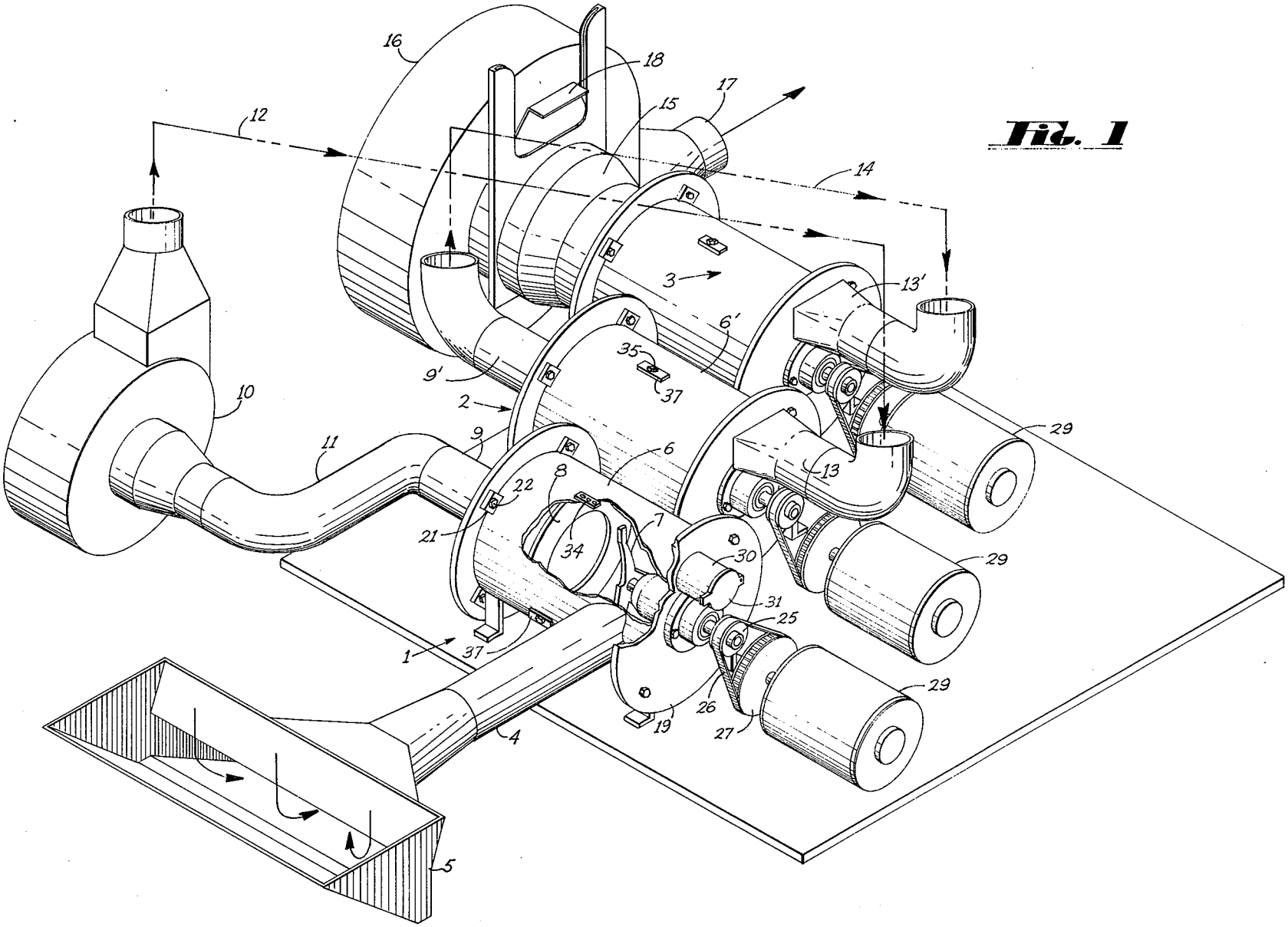
FIG. 1 is a perspective view, with parts broken away and others schematically illustrated, of a three stage fiberizing device in accordance with the invention.

Referring first to FIG. 1 of the drawings, the device illustrated comprises a three stage unit having a first stage, indicated generally at 1, a second stage, indicated generally at 2, and a third stage, indicated generally at 3. As previously indicated, the device may comprise one, two or more stages, depending upon the nature of the fibers being handled, and each stage is of basically the same construction as will be explained in greater detail hereinafter. Small pieces of moist pulp will be fed into the first stage unit through an inlet conduit 4, which in this instance is connected to the chute 5 comprising the discharge side of a conventional picker (not shown) which breaks up a continuous mat or web of pulp fibers into relatively small pieces of a size to be introduced into the stage 1 unit. In the embodiment illustrated, the conduit 4 enters the tubular chamber 6 of the first stage unit radially, although it may enter the chamber coaxially through the leading end thereof, if so desired, the principal consideration being that the pieces of pulp are introduced in back of the fiberizing blade 7. An adjustable orifice plate 8 is mounted within the chamber 6 intermediate the fiberizing blade 7 and the discharge orifice 9. A centrifugal fan 10 is connected through conduit 11 to the discharge orifice 9, the fan acting to draw a vacuum on the chamber 6.

The second stage unit 2 is of essentially the same construction as the first stage unit, but in this instance the output side of the centrifugal fan 10 is connected through conduit 12 to an intake manifold 13 at the leading end of the second stage unit, the inlet manifold acting to introduce the fibers into the second stage unit coaxially with respect to its tubular chamber 6'. The second stage chamber 6' has an outlet orifice 9' through which the fibers are removed from the second stage unit, the outlet orifice 9' being connected through a conduit 14 to the intake manifold 13' of the third stage unit 3.

The third stage unit 3 is of the same basic construction as units 1 and 2 and functions in like manner, the unit 3 having a discharge manifold 15 operatively connected to a centrifugal fan 16 which discharges the fibers through an outlet orifice 17 which may be operatively connected to any succeeding processing station, such as a fiber drier or a device for collecting the individual fibers. In the embodiment illustrated, the centrifugal fan 16 is provided with an air flow adjusting gate 18, and the centrifugal fan 16 serves to draw vacuum on both the second and third stage fiberizing units. If desired, a separate centrifugal fan may be interposed in the conduit 14 which transports the fibers from the second to the third stage unit.

Figure 2:
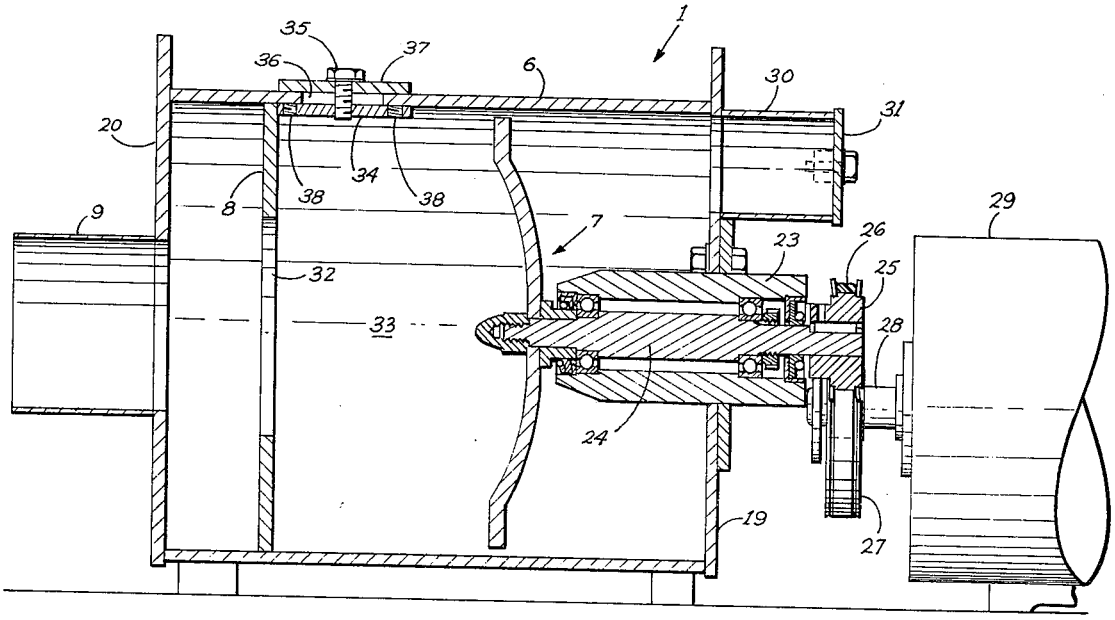
FIG. 2 is an enlarged vertical sectional view of the fiberizing chamber and its operating components.

With the foregoing general organization in mind, reference is next made to FIG. 2 of the drawings which, while specifically illustrating the first stage unit, will also serve to illustrate the construction of the second and third stage unit since they are basically the same. As seen therein, the tubular chamber 6 is closed at its leading end by an end plate 19 and at its trailing end by an end plate 20. Preferably, the end plates will be detachably secured to the housing 6, as by means of the mounting ears 21 and bolts 22 seen in FIG. 1. The leading end plate 19 mounts a bearing housing 23 in which the drive shaft 24 for the fiberizing blade 7 is rotatably journaled, the drive shaft 24 having a gearbelt pulley 25 keyed to its outermost end, the pulley 25 being engaged by a gearbelt 26 which also engages the gearbelt pulley 27 secured to drive shaft 28 of drive motor 29 which serves to drive the fiberizing blade.

The end plate 19 also mounts an air inlet 30 having an adjustable cover 31 to permit the air inlet to be opened and closed as required. The air inlet 30, in addition to controlling the quantity of air drawn into the chamber 6, also may be utilized as a means for introducing heated air into the chamber, the air inlet being connected to a source of heated air (not shown) such as an electrical heating unit through which the air passes as it is drawn into the chamber 6.

The orifice plate 8 is mounted down-stream with respect to the fiberizing blade 7 and is provided with a centrally disposed orifice 32 of restricted diameter, the orifice plate 8 defining a fiberizing zone 33 lying between the fiberizing blade 7 and the orifice plate 8. The orifice plate is adustable to vary the size of the fiberizing zone 33, the plate having a plurality of mounting arms 34 engageable by bolts 35 extending through elongated slots 36 in chamber 6, the bolts being mounted on retainer bars 37 which overlie the slots 36. With this arrangement, the orifice plate 8 may be adjusted to increase or decrease the size of the fiberizing zone 33; and the range of adjustment may be increased by providing the mounting arms 34 with additional threaded openings 38 to selectively receive the adjustment bolts 35.

Figure 3:
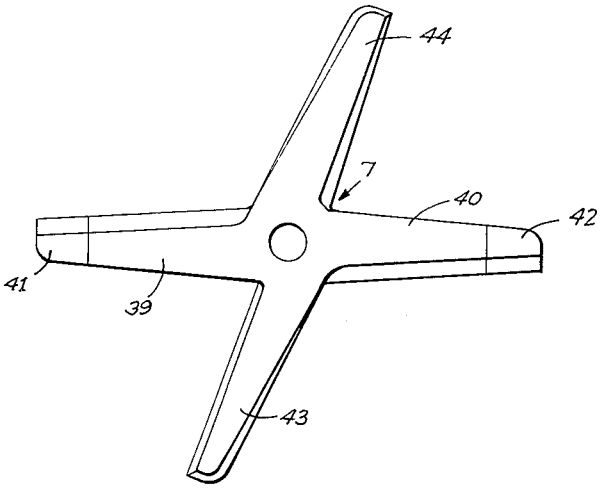
FIG. 3 is a plan view of the fiberizing blade.
Figure 4:
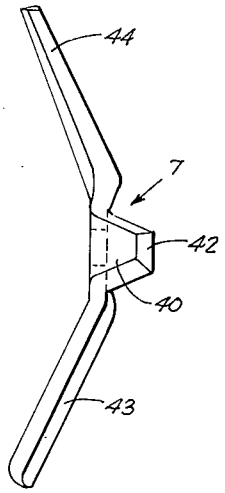
FIG. 4 is a side elevational view of the fiberizing blade, taken from the right side of FIG. 3.
Figure 5:
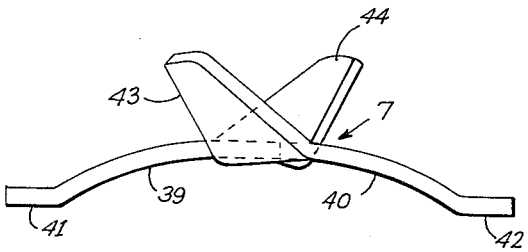
FIG. 5 is a side elevational view of the fiberizing blade.

A preferred configuration for the fiberizing blade 7 is illustrated in FIGS. 3, 4 and 5, the blade having an opposing pair of arms 39 and 40 which curve outwardly and terminate at their outermost ends in flattened tips 41 and 42. The intermediate blades 43 and 44 are inclined at acute angle with respect to the blades 39 and 40, respectively, and are also inclined outwardly in the manner illustrated. While the illustrated configuration of the blades is preferred, it will be understood that other blade configurations may be employed. It is preferred that the tips of the blades lie in close proximity to the inner wall surface of chamber 6, preferably only with operating clearance between the blade tips and the inner wall surface of the chamber.

It will be understood that the construction of the second and third stage units will be essentially identical to the first stage unit insofar as their internal components are concerned. In an exemplary embodiment, the chamber 6 has a ten inch interior diameter with the orifice 32 in orifice plate 8 having a five inch diameter. The function of the orifice plate is to increase retention time of the fibers within the fiberizing zone 33 to insure maximum fiber separation while at the same time permitting removal of the separated fibers quickly and efficiently in a manner which will promote drying and prevent knot formation.

In the operation of the device, the fiber pieces are introduced into the first stage unit 1 in back of the blade 7, i.e., between the blade 7 and the leading end wall 19. The blade 7, which may be operated at a tip speed of approximately 20,000 feet per minute, creates a turbulent vortex within the chamber 6 but no appreciable pressure differential within the chamber; that is, the blade does not induce fiber flow from the leading toward the trailing end of the chamber. Rather, fiber flow is induced and controlled by the centrifugal fan 10 which draws a vacuum on the chamber through adjustable orifice plate 8 and discharge orifice 9. The rate of flow of the fibers and their retention within the fiberizing zone 33 may be controlled by adjusting the cover 31 of air inlet 30, with the size of the fiberizing zone and hence retention time additionally controlled by the adjustment of the location of orifice plate 8. These adjustments will be empirical, consistent with the objectives of securing maximum fiber separation while minimizing fiber damage and knot formation.

With the arrangement just described, fiber flow is induced and controlled independently of the action of the fiberizing blade 7 and results in a favorable vortex placement around the fiberizing blade plane. In fact, the fiberizing blade may be used to produce a slight pressure differential in the direction opposite to the direction of fiber flow to further enhance the vortex action in the plane of the fiberizing blade.

The extent of fiber separation which occurs in the first stage unit 1 will depend upon the nature of the fibers being separated and the manner in which they were treated. In some instances, wholly adequate separation for a given purpose may be achieved in the first stage; however, where the fibers have been impregnated with wet strength resins, second and third stage fiberization is usually required to effect substantially complete fiber separation. As in the case of the first stage unit, the second and third stage units may be adjusted to control fiber retention time as well as fiber flow. Thus, the air flow adjusting gate 18 at the end of the third stage unit may be utilized to control fiber flow through the second and third stage units; and if required, an additional vacuum inducing fan may be interposed between the second and third stage units.

As should be evident, modifications may be made in the invention without departing from its spirit and purpose; numerous such modifications have already been set forth, and others will be apparent to those skilled in the art consistent with the spirit and purpose of the disclosed invention. For example, while the fiberizing units are shown in side-by-side relation, they may be arranged in end-to-end relation depending upon the space available. Size, of course, does not constitute a limitation on the invention, and while a representative example has been given, the size may be varied to suit the conditions of use.

The embodiments of the invention in which an exclusive property or privilege is claimed are defined as follows:

1. Apparatus for effecting the separation of fibrous agglomerates into individual fibers comprising an elongated tubular chamber having a leading end and a trailing end, a fiberizing blade rotatably mounted within said chamber toward the leading end thereof, means for rotating said blade, means for introducing fibrous agglomerates into said chamber ahead of said fiberizing blade, a discharge opening at the trailing end of said chamber, an orifice plate mounted within said chamber between said fiberizing blade and said discharge opening, said orifice plate lying in spaced relation to said fiberizing blade to define a fiberizing zone therebetween, and means for drawing a vacuum on said discharge opening.

2. The apparatus claimed in claim 1 including means adjustably mounting said orifice plate within said chamber, whereby the size of the fiberizing zone may be varied.

3. The apparatus claimed in claim 2 including air inlet means at the leading end of said chamber, and adjustable means for selectively opening and closing said air inlet means.

4. The apparatus claimed in claim 3 wherein said fiberizing blade is configured to produce a turbulent vortex within said chamber without creating a pressure differential which would induce fiber flow from the leading to the trailing end of the chamber.

5. The apparatus claimed in claim 4 wherein the means for drawing a vacuum on said discharge opening comprises a centrifugal fan.

6. The apparatus claimed in claim 1 in combination with a second tubular chamber having a leading end and a trailing end, an inlet opening at its leading end and a discharge opening at its trailing end, a fiberizing blade rotatably mounted within said second chamber toward the leading end thereof, means for rotating said fiberizing blade, and an orifice plate mounted within said second chamber between said fiberizing blade and said discharge opening, said orifice plate lying in spaced relation to said fiberizing blade to define a fiberizing zone therebetween, and conduit means interconnecting the inlet opening of said second chamber with the discharge opening of said first named chamber.

7. The apparatus claimed in claim 6 wherein the means for drawing a vacuum on the discharge opening in said first named chamber comprises a centrifugal fan interposed in the conduit means interconnecting the inlet opening of said second chamber with the discharge opening in said first named chamber.

8. The apparatus claimed in claim 7 in combination with a third tubular chamber having a leading end and a trailing end, an inlet opening at its leading end and a discharge opening at its trailing end, a fiberizing blade rotatably mounted within said third chamber toward the leading end thereof, means for rotating said fiberizing blade, and an orifice plate mounted within said third chamber between said fiberizing blade and said discharge opening, said orifice plate lying in spaced relation to said fiberizing blade to define a fiberizing zone therebetween, and conduit means interconnecting the inlet opening of said third chamber with the discharge opening of said second chamber.

9. The apparatus claimed in claim 8 including means for drawing a vacuum on the said third chamber through the discharge opening therein.

10. The apparatus claimed in claim 9 wherein the means for drawing a vacuum on said third chamber comprises a centrifugal fan operatively connected to the discharge opening in said third chamber.

11. The apparatus claimed in claim 10 including air flow adjusting means interposed between said last named centrifugal fan and the discharge opening in said third chamber.

12. Apparatus for effecting the separation of fiberous agglomerates into individual fibers in a gaseous media comprising first, second and third elongated tubular chambers each having a leading end and a trailing end, an inlet opening at the leading end of each chamber and a discharge opening at the trailing end of each chamber, a fiberizing blade rotatably mounted within each chamber in spaced relation to the leading end thereof, means for rotating said fiberizing blades, orificial constricting means mounted within each said chamber intermediate said fiberizing blade and said discharge opening in cooperating fiberizing relationship with said fiberizing blade, conduit means interconnecting the discharge opening in said first chamber with the inlet opening in said second chamber, and additional conduit means connecting the discharge opening in said second chamber with the inlet opening in said third chamber, means for introducing a gaseous media into said chambers, and pressure differential creating means for producing a fiber carrying flow of the gaseous media from the leading to the trailing end of each chamber.

13. The apparatus claimed in claim 12 wherein the pressure differential creating means comprises a centrifugal fan interposed in the conduit means interconnecting the inlet opening in said second chamber with the discharge opening in said first chamber.

14. The apparatus claimed in claim 13 wherein said pressure differential creating means also includes a centrifugal fan operatively connected to the discharge opening in said third chamber.

15. The apparatus claimed in claim 14 wherein the means for introducing a gaseous media into said chambers comprises a gaseous media inlet at the leading end of said first chamber.

16. The apparatus claimed in claim 15 including adjustable means for selectively opening and closing said gaseous media inlet.

17. The apparatus claimed in claim 16 including gaseous media flow adjusting means interposed between the discharge outlet of said third chamber and said second centrifugal fan.

18. The apparatus claimed in claim 12 wherein said fiberizing blade is configured to produce a turbulent vortex within said chamber without creating a pressure differential therein.

19. The apparatus claimed in claim 18 wherein said fiberizing blade comprises a first set of opposing arms of outwardly curved configuration, terminating at their outermost ends in flattened tips, and a second set of opposing arms, each of the arms in said second set lying at an acute angle with respect to one of the arms in said first set, said second set of arms being inclined outwardly in the opposite direction with respect to the direction of curvature of said first set of arms.

20. The apparatus claimed in claim 19 wherein the tips of the arms of said fiberizing blades lie in close proximity to the inner surface of the chamber in which each said blade is mounted.

* * * * *